United States Patent [19]

Smith

[11] Patent Number: 4,574,412

[45] Date of Patent: Mar. 11, 1986

[54] L-SHAPED ANCHORED PILLOW

[76] Inventor: Homer H. Smith, 90 Arden Park, Detroit, Mich. 48202

[21] Appl. No.: 619,189

[22] Filed: Jun. 11, 1984

[51] Int. Cl.[4] ..... A47G 9/00

[52] U.S. Cl. ..... 5/436; 5/490

[58] Field of Search ..... 5/434, 436, 435, 437, 5/441, 490, 431; D6/601

[56] References Cited

U.S. PATENT DOCUMENTS

| | | | |
|---|---|---|---|
| 1,705,326 | 3/1929 | Buchman | 5/434 |
| 1,974,723 | 9/1934 | Richig | 5/434 |
| 2,149,140 | 2/1939 | Gonzalez-Rincones | 5/436 |
| 2,720,660 | 10/1955 | Smith . | |
| 2,795,802 | 6/1957 | Myers | 5/436 |
| 3,608,964 | 9/1971 | Earl | 5/436 |
| 3,837,020 | 9/1974 | Bosch | 5/411 |
| 4,163,297 | 8/1979 | Neumark | 5/455 |
| 4,173,048 | 11/1979 | Varaney | 5/436 |

FOREIGN PATENT DOCUMENTS

| | | | |
|---|---|---|---|
| 429738 | 9/1911 | France | 5/490 |

*Primary Examiner*—Alexander Grosz
*Attorney, Agent, or Firm*—Harvey B. Jacobson

[57] ABSTRACT

An L-shaped pillow and pillow case combined with an anchor structure for retaining the pillow and pillowcase in position on a bed with one leg of the L-shaped pillow and pillowcase being positioned under the head in a conventional manner and the other leg of the pillow and pillowcase extending longitudinally alongside of a person reclining on the bed to provide support substantially throughout the length of the back of a person using the pillow and pillowcase. The anchor includes a sheet or panel of fabric or similar material placed on the bed under the person using the pillow with the anchor panel being secured to the bed if desired. The pillow includes anchoring tabs which extend through openings in the pillowcase for connection with the sheet or panel along one edge portion thereof by the use of hook and loop fastener material such as that sold under the trademark "Velcro" or similar detachable fastening arrangements. The pillow is constructed of conventional cushioning or padding material or may be inflated or filled with water or other liquid and is enclosed in a fabric cover and provided with a fabric pillowcase with the specific configuration of the pillow and corresponding pillowcase and the anchoring arrangement for retaining the pillow in position on the bed providing effective comfort to a person using the pillow.

4 Claims, 5 Drawing Figures

L-SHAPED ANCHORED PILLOW

BACKGROUND OF THE INVENTION

1. Field of the Invention

The present invention generally relates to an anchored pillow of L-shaped configuration with the pillow including a correspondingly shaped pillowcase and the pillow including anchoring tabs extending through openings in the pillowcase for detachable connection with an underlying sheet or panel placed on the surface of the bed in underlying relation to a person using the pillow so that the weight of the person on the anchoring sheet or panel will retain the pillow in optimum position with one leg of the pillow being positioned under the user's head at the head area of the bed in a usual position and the other leg of the pillow extending downwardly along the back of a person reclining on the bed thereby providing effective support for the back area of the person using the pillow.

2. Description of the Prior Art

Conventional pillows are constructed of a cushioning or padding material of lightweight, resilient construction with the padding material usually being retained in a fabric cover or the like with the pillow being placed in a fabric pillowcase. While conventional pillows provide adequate support for the head of the user, in some instances, conventional pillows do not provide support for the neck and other areas. In view of this, various types of specially shaped and contoured pillows have been provided for use to support the head and neck area when the user is utilizing the pillow in a conventional manner on a bed or when reclining in a chair, travelling in a vehicle or the like. One problem which has continued to exist is the accidental movement of the pillow to a position where it does not provide adequate support and which may actually cause discomfit.

SUMMARY OF THE INVENTION

An object of the present invention is to provide an L-shaped pillow and correspondingly shaped pillowcase and an anchor structure for securing the pillow in optimum position in relation to a person using the pillow when lying on the upper surface of the bed.

Another object of the invention is to provide a pillow in accordance with the preceding object in which the L-shaped pillow extends along and provides support for the major portion of the back area of the person using the pillow thereby providing more comfortable support for the back area.

A further object of the invention is to provide a pillow in accordance with the preceding objects in which the anchor structure includes a sheet or panel placed on the upper surface of the bed under the person using the pillow with the anchoring sheet or panel being connected to the pillow by tabs attached to the pillow extending through openings in the pillowcase with the tabs and anchoring sheet including coacting detachable fastening arrangements such as a hook and loop fastener material such as that sold under the trademark "Velcro" to effectively support the pillow in position but enable removal thereof when desired.

Still another object of the invention is to provide a pillow in accordance with the preceding objects which is simple in construction, easy to assemble, capable of use by two individuals oriented in back-to-back position and which may be optionally provided with heating elements to further enhance the comfort of the user of the pillow.

These together with other objects and advantages which will become subsequently apparent reside in the details of construction and operation as more fully hereinafter described and claimed, reference being had to the accompanying drawings forming a part thereof, wherein like numerals refer to like parts throughout.

DESCRIPTION OF THE PREFERRED EMBODIMENT

Figure 1:
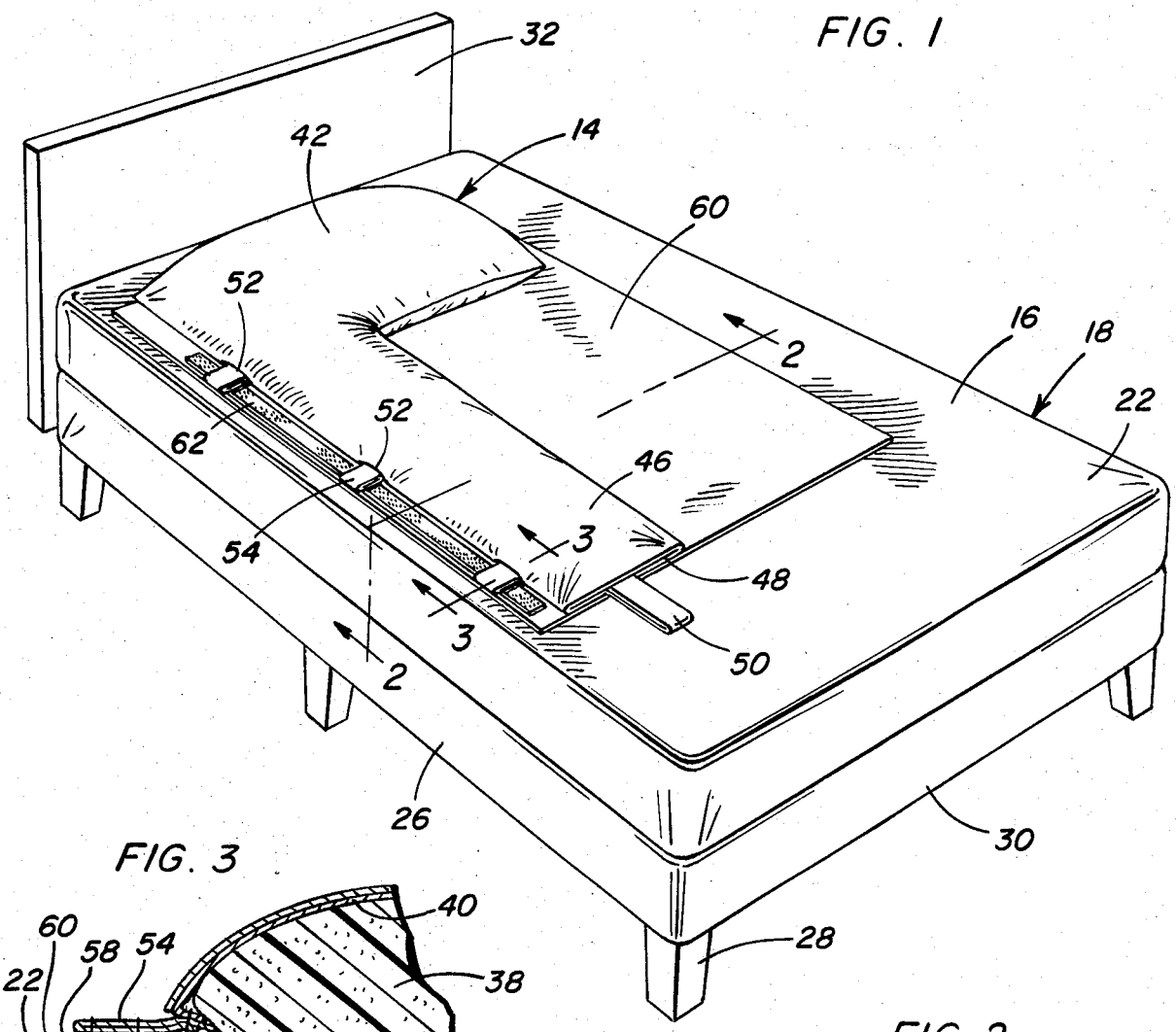
FIG. 1 is a perspective view of the L-shaped anchored pillow of the present invention positioned on the upper surface of the bed.

Referring now specifically to the drawings, the pillow of the present invention is generally designated by reference numeral 10 and the pillowcase is generally designated by numeral 12 with the assembled pillow and pillowcase being designated generally by reference numeral 14. As illustrated in FIG. 1, the pillow and pillowcase assembly are placed on the upper surface 16 of a bed generally designated by numeral 18 and more specifically on the upper surface of the mattress 20 which has the usual sheet 22 thereon with the mattress being supported from a spring assembly such as an inner spring assembly 24 carried by a bed frame or bed rails 26 supported by legs 28 and including a footboard 30 and a headboard 32. The bed structure itself is completely conventional and the pillow 10 may be utilized with any type of bed such as a Hollywood bed, single bed, double bed, king-size, queen-size and the like, and may also be used on other supporting surfaces on which a person may recline.

Figure 3:
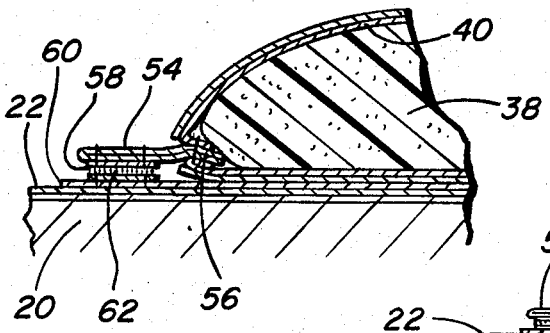
FIG. 3 is a transverse sectional view, on an enlarged scale, taken substantially upon a plane passing along section line 3—3 on FIG. 1 illustrating the structure of the anchoring tabs and their association with the pillowcase and underlying anchoring sheet or panel.
Figure 2:
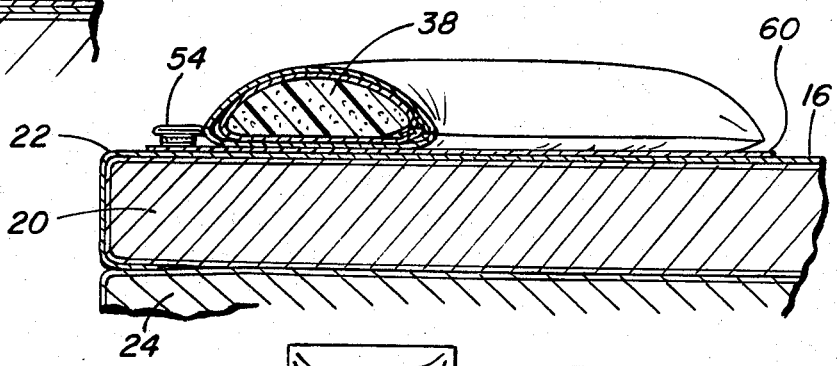
FIG. 2 is a transverse sectional view, on an enlarged scale, taken substantially upon a plane passing along section line 2—2 on FIG. 1 illustrating the association of the pillow with the mattress on the bed.
Figure 4:
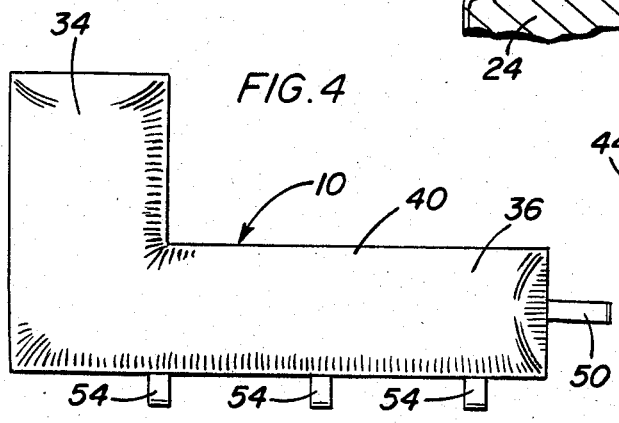
FIG. 4 is a top plan view of the pillow per se.
Figure 5:
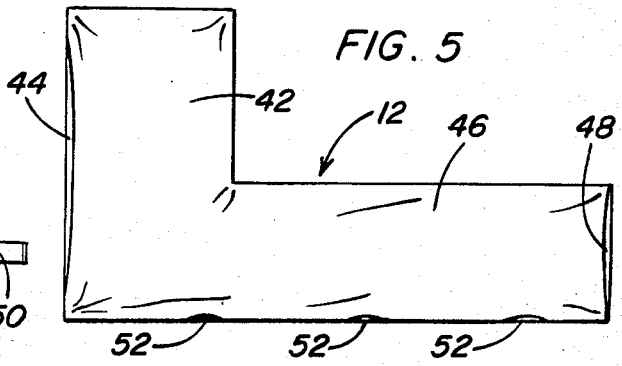
FIG. 5 is a top plan view of the pillowcase per se.

The pillow 10 is generally of L-shaped configuration and includes a relatively short lateral leg 34 and an elongated longitudinal leg 36 and includes a filling of cushioning material 38 enclosed by a cover 40 which represents conventional pillow construction with the cover 40 being fabric material and the cushioning filler 38 being natural material such as feathers, down or synthetic material such as foam plastic or the like or any other cushioning filler normally employed in pillow construction. The density, resilient characteristics, height and width of the pillow may vary with the laterial leg 34 of the pillow 10 being standard in size as compared to conventional pillows and adapted to extend under and provide adequate support to the head and adjacent neck area of the person using the pillow. The leg 36 is longer than the leg 34 and is of less transverse dimension and has a length adapted to extend substantially throughout the length of the back area of the person using the the pillow with the tail end of the pillow extending for a major portion of the length of the mattress as illustrated in FIG. 1 to provide support for the back area throughout the length of the back and down to the area to the rear of the legs especially above the knees. The pillowcase 12 is shaped correspondingly to the pillow 10 with the transverse leg portion 42 including an opening 44 along the long side thereof for insertion of the pillow 10. Also, the free end of the elongated leg portion 46 is provided with a similar opening 48 to enable a longitudinally projecting tab 50 on the corresponding end of the leg 36 of the pillow 10 to extend outwardly therefrom. Also, the pillowcase 12 includes three longitudinally spaced openings 52 along the outer edge thereof for receiving three projecting tabs 54 on the corresponding edge of the pillow 10 with the tabs 54 being stitched into the seam 56 in the cover 40 for the pillow 10 as illustrated in FIG. 3. Also, each of the tabs 54 is provided with "Velcro" material 58 on the bottom surface thereof. "Velcro" is a registered trademark used with a hook and loop, self-adhering fastening tape disclosed in U.S. Pat. No. 2,717,434, issued Sept. 13, 1955.

Positioned in underlying relation to the pillow is an anchor sheet or panel 60 of rectangular construction and having a width and length at least equal to the pillow so that a person using the pillow will lie on the sheet 60. The peripheral edge of the sheet outwardly of the elongated edge of the pillow 10 is provided with a strip 62 of hook and loop fastener material so that the fastener material 58 on the tabs 54 may be anchored thereto at any adjusted position longitudinally of the strip 62. Thus, the pillow 10 will be anchored in relation to the sheet 60 and the sheet 60 will be anchored in position on the upper surface 16 of the bed 18 by the weight of the person resting on the bed with their head on the leg 34 of the pillow 10.

The anchoring sheet or panel 60 may be fabric sheeting of conventional construction and the pillowcase 12 also may be of fabric material having any suitable print pattern, color fabric or the like. The tab 50 may be in the form of a loop so that a flexible member can be attached thereto and connected to the footboard, the underlying supporting spring assembly or an inserted board or panel between the mattress and spring assembly. Also, the anchoring sheet may be the mattress sheet fitted thereto in a conventional manner with the fastening strip 62 attached in a conventional manner. With this arrangement, the pillow 10 is detachably anchored in desired position so that a person lying on the bed may position themselves on their side and by rolling toward the leg 36 of the pillow, receive support substantially throughout the length of their back and adjacent rear surfaces of the legs when desired. Also, the device may be used by two individuals lying on the same bed in back-to-back relation with the second individual utilizing a conventional pillow in alignment with the leg portion 34 of the pillow 10. The pillow may be arranged on either side of the bed so that users who may find it uncomfortable to lay on one side may utilize the pillow by orienting is so that they can lay on their comfortable side. If desired, a thermostatically-controlled heating element, such as utilized in a heating pad, can be incorporated into the pillow, especially the elongated leg portion 36 thereof to introduce heat therapy to the portions of the person's body which engages the heated portion of the pillow.

While a padding filled pillow is disclosed specifically, it is within the purview of this invention for the pillow to be inflated with air or filled to a desired degree with water or a similar liquid to enhance the comfort to the user. Also, the anchor panel 60 may be secured to the bed sheet 16 or otherwise secured in place by conventional fasteners to keep panel 60 in a generally smooth condition. Likewise, the continuous fastening strip 62 may be in the form of spaced tabs of hook and loop fastener material secured to the panel 60 by stitching in order to retain the cost of the device as low as possible. Also, the tabs 54 on the pillow may be attached to the pillowcase and two separate pillows may be provided with one pillow being inserted from the end of the elongated leg portion 46 and the other pillow inserted in the end of the transverse leg portion of the pillow cover. Another alternative structure for anchoring the pillow is the construction of the tabs 54 as loops for receiving a narrow elongated flexible strap or band having its ends extending between the end portions of the mattress and underlying springs, secured to the mattress or springs or secured to the headboard and footboard or components of the bed.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A pillow for providing support for the head and longitudinal portion of a person using the pillow comprising a cushioned pillow member of L-shaped configuration having a relatively short lateral leg portion adapted to support the head and neck area of a person using the pillow and an elongated leg portion substantially perpendicular to the lateral leg portion adapted to extend along, engage and support an elongated portion of the body of a person using the pillow, and a pillowcase of corresponding shape and configuration covering the pillow, said pillowcase including an open end enabling insertion of the pillow, said pillow including a plurality of anchoring tabs projecting from one edge thereof, said pillowcase having a plurality of corresponding openings receiving the tabs, and means engaged with the tabs for securing the pillow in place on a supporting surface, said means securing the pillow in place on a supporting surface including an anchoring sheet underlying the pillow and projecting therefrom so that a person using the pillow will be disposed on the sheet for anchoring the sheet on a supporting surface, said sheet including a fastening strip along one edge thereof, said tabs on the pillow including fastening means associated with the fastening strip to releasably secure the pillow in position on the anchoring sheet, said anchoring tabs being positioned along the outer edge of the elongated leg portion of the pillow with their being three anchoring tabs and three corresponding openings in the pillowcase, the end of the pillowcase receiving the end of the elongated leg portion of the pillow remote from the lateral leg portion being open and said pillow including a tab on the end of the elongated leg portion extending through the opening in the end of the pillowcase receiving the end of the elongated leg portion of the pillow.

2. The assembly as defined in claim 1 wherein said elongated leg portion of the pillow extends substantially throughout the length of the back of the person using the pillow thereby providing support for substantially the entire back area of the person using the pillow.

3. The assembly as defined in claim 2 wherein said fastening strip and fastening means on the tabs includes self-adhering hook and loop pile fastener tape.

4. The assembly as defined in claim 3 wherein the anchoring sheet has a width and length corresponding to the length of the lateral leg portion and the length of the elongated leg portion to completely underlie all surfaces of the pillow and pillowcase and occupy a generally rectangular area defined by a projection of the end edges of the leg portions of the pillow.

* * * * *